United States Patent [19]

McGriff

[11] Patent Number: 4,597,602

[45] Date of Patent: Jul. 1, 1986

[54] LOAD LEVELING DEVICE

[76] Inventor: Donald D. McGriff, 415 S. Main St., Baxter, Iowa 50028

[21] Appl. No.: 707,814

[22] Filed: Mar. 4, 1985

[51] Int. Cl.[4] ..... B66C 1/10

[52] U.S. Cl. ..... 294/81.3; 294/67.5

[58] Field of Search ..... 294/67.21, 67.5, 81.1–81.5, 294/82.12, 86.41

[56] References Cited

U.S. PATENT DOCUMENTS

| | | | |
|---|---|---|---|
| 1,649,904 | 11/1927 | Longgood | 294/81.3 |
| 2,142,416 | 1/1939 | Russell | 294/81.5 X |
| 2,399,360 | 4/1946 | Lacey | 294/67.5 X |
| 2,412,488 | 12/1946 | Austin | 294/81.3 |
| 2,703,252 | 3/1955 | Blackwell | 294/67.5 |
| 2,925,300 | 2/1960 | Kelley | 294/67.21 X |
| 2,989,287 | 6/1961 | Brutscher, Sr. et al. | 254/356 |
| 3,146,016 | 8/1964 | Daymon | 294/81.3 |
| 3,301,420 | 1/1967 | Bopp | 294/67.21 X |
| 3,433,459 | 3/1969 | Logan | 294/81.3 X |
| 3,751,097 | 8/1973 | Jones et al. | 294/81.3 |
| 3,762,755 | 10/1973 | Saether | 294/67.21 |
| 4,166,647 | 9/1979 | Schmidt | 294/86.41 |
| 4,431,223 | 2/1984 | Miller | 294/67.5 X |

*Primary Examiner*—Johnny D. Cherry

*Attorney, Agent, or Firm*—Zarley, McKee, Thomte, Voorhees & Sease

[57] ABSTRACT

The load leveling device of the present invention comprises an elongated frame assembly having an elongated track frame therein. A carriage assembly is movably mounted to the track assembly for moving longitudinally along the length of the track assembly. A lead screw threadably engages the carriage assembly for causing the movement of the carriage assembly along a track frame. An attachment link is connected to the carriage assembly and is adapted to be connected to a lifting device. The opposite ends of the frame are adapted to be connected to the load. In a modified form of the invention, three of the load leveling devices are connected together with one of the devices having the opposite ends of its frame connected to the movable carriage assemblies of the other two devices.

9 Claims, 11 Drawing Figures

LOAD LEVELING DEVICE

BACKGROUND OF THE INVENTION

This invention relates to a load leveling device for connecting a load to a lifting device.

When lifting heavy loads from a suspended cable or chain, several difficulties are encountered in placing the load at the desired angle of inclination. For example, a block and tackle is conventionally used to lift a vehicle engine during the mounting of the engine in the vehicle. The engine is usually suspended from two or more cables, and it is sometimes desirable to tilt the angle of the engine during the mounting process. At certain stages of the operation, it is desirable to have the engine in a level attitude, whereas in other stages of the mounting operation, it is desirable to have the engine inclined at an angle. Changing or adjusting this angle of attitude is difficult with conventional equipment.

Difficulty is also encountered with lifting devices such as cranes when it is desired to suspend the load from four points. The crane operator has considerable difficulty in rigging the cable so that the particular load is held at the desired angle and so that the load is evenly distributed over the four points from which it is suspended.

Therefore, a primary object of the present invention is the provision of an improved load leveling device for connecting a load to a lifting device.

A further object of the present invention is the provision of a load leveling device which will permit the angle of the load to be adjusted after the load has been suspended from the lifting device.

A further object of the present invention is the provision of a load leveling device which has almost infinite adjustment.

A further object of the present invention is the provision of a load leveling device which can be adjusted with a minimum of friction and binding.

A further object of the present invention is the provision of a load leveling device which is sturdy in construction and which will support substantial loads.

A further object of the present invention is the provision of a load leveling device which can be adjusted by electrical power means, thereby making possible the use of remote controls for adjusting the level and attitude of the load.

A further object of the present invention is the provision of a load leveling device which is economical to manufacture, durable in use and efficient in operation.

SUMMARY OF THE INVENTION

The load leveling device of the present invention utilizes an elongated frame assembly having two track members or bars mounted thereto in spaced apart parallel relation. A movable carriage assembly includes a pair of bearing wheels which bear against the lower surfaces of the track members. A link is connected to the carriage assembly and extends upwardly between the track members where it can be pivotally mounted to the load lifting device.

A lead screw threadably engages the carriage assembly and is rotatably mounted to the elongated frame assembly. By rotating the lead screw, it is possible to move the carriage assembly longitudinally with respect to the elongated track frames. The bearing wheels permit the longitudinal movement with a minimum of friction.

The opposite ends of the frame assembly are adapted to be connected to two cables or chains which carry the load. By rotating the lead screw, it is possible to move the carriage assembly longitudinally with respect to the frame, and thereby adjust the point at which the lifting device is positioned relative to the center of gravity of the load suspended from the frame assembly.

In a modified form of the invention, three frame assemblies such as described above, are connected in an H or I configuration. One of the frame assemblies has its opposite ends connected to the movable carriage assemblies of the other two frame assemblies. Four cables or chains are suspended from the two end frame assemblies. The load lifting device is connected to the movable carriage assembly of the middle or cross-bar frame assembly. Thus, it is possible to provide three adjustments in order to level the device being suspended from the four cables. movement of the carriage assembly of the crossbar frame assembly provides one adjustment. The other adjustment is achieved by moving the carriage assemblies of the other two frame assemblies.

The lead screws may be operated by a hand crank handle or they may be connected to an electric motor or other type of power drive device such as a hydraulic motor.

DETAILED DESCRIPTION OF THE PREFERRED EMBODIMENT

Figure 5:
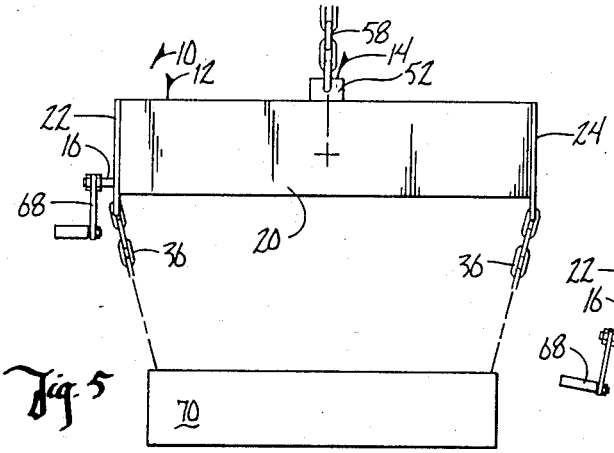
FIG. 5 is a side view showing the leveling device in use with a load.
Figure 6:
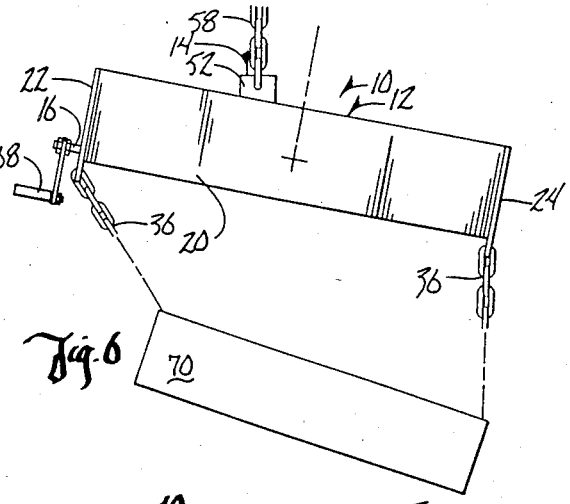
FIG. 6 is a view similar to FIG. 5, but showing the effect of adjusting the carriage assembly longitudinally.

Referring to FIGS. 1–6, the numeral 10 generally designates the load lifting device of the present invention. Device 10 comprises an elongated frame assembly 12, a carriage assembly 14 (FIG. 4), and a lead screw 16. Frame assembly 12 comprises a pair of side frame members 18, 20, a pair of end frame members 22, 24, a pair of track frames or bars 26, 28, and a pair of angles 30, 32. End frame members 22, 24 are each provided with a pair of openings 34 for receiving a chain 36 for carrying a load such as shown in FIGS. 5 and 6. Track frames 26, 28 are parallel to one another and are spaced apart, leaving an opening 38 therebetween.

Carriage frame 14 comprises a sleeve 40 having a threaded bore 42 extending therethrough. Welded or otherwise secured to sleeve 40 are a pair of bearing supports 44 having a pair of roller bearings or wheels 46, 48 rotatably mounted thereto. Bearing supports 44 each have an outwardly extending horizontal wing flange 50 thereon. Bearing supports 44 are spaced apart, and in the space between bearing supports 44 is a lifting link 52. A bearing axle or pin 54 extends through bearings 46, 48 and also through the lower end of link 52 so as to provice pivotal mounting of bearings 46, 48 and link 52 to the bearing supports 44. The upper end of link 52 includes a hole 56 for receiving a chain 58 which can be mounted to the lifting device, such as a block and tackle or a crane cable.

Figure 1:
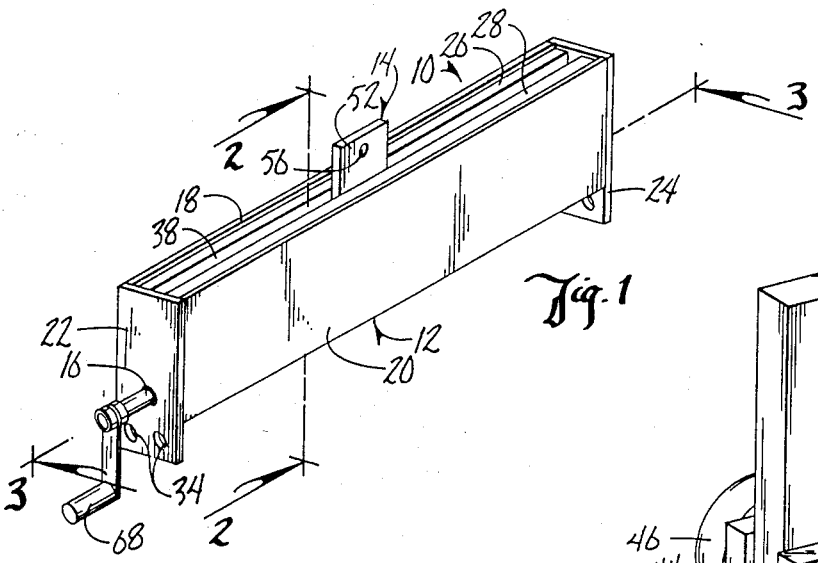
FIG. 1 is a perspective view of the load leveling deice of the present invention.
Figure 4:
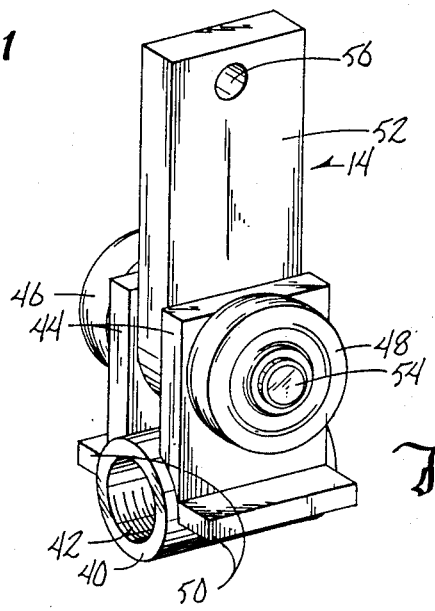
FIG. 4 is an enlarged detail perspective view of the carriage assembly of the present invention.
Figure 2:
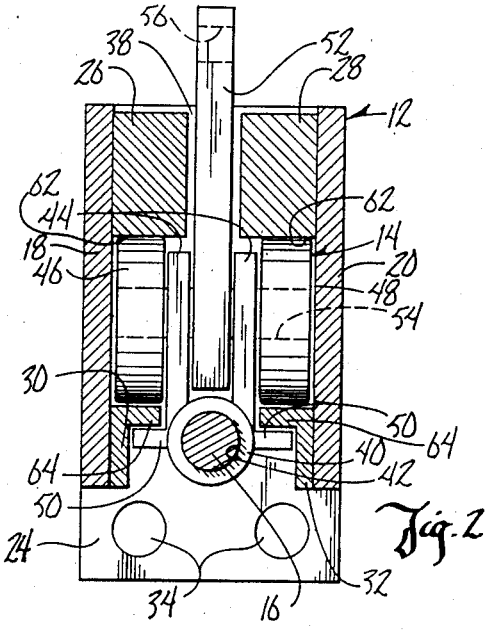
FIG. 2 is a sectional view taken along line 2—2 of FIG. 1.
Figure 3:
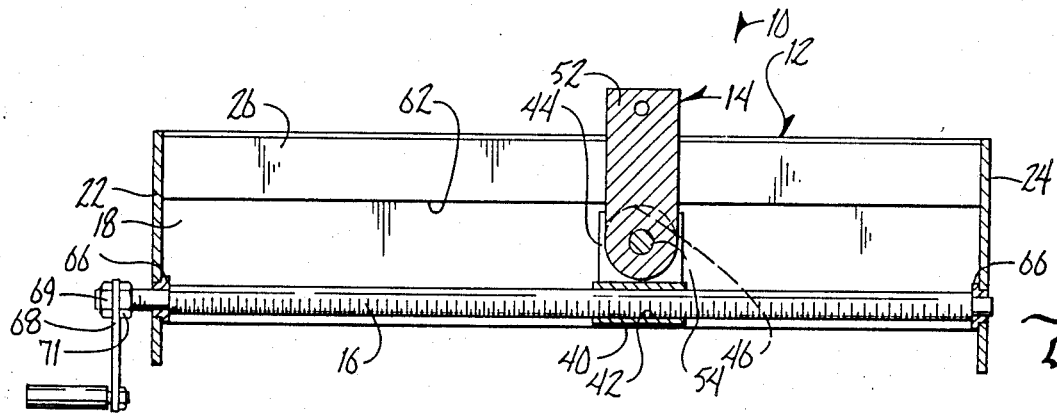
FIG. 3 is a sectional view taken along line 3—3 of FIG. 1.

Carriage assembly 14 is movably mounted with respect to frame assembly 12 as shown in FIGS. 2 and 3. Bearing wheels 46, 48 engage the downwardly presented surfaces 62 of track frames 26, 28 and are adapted to roll along the length of track frames 26, 28. Link 52 extends upwardly through space 38 between track frames 26, 28. The horizontal wing flanges 50 are nested below the horizontal inwardly extending flanges 64 of angles 30, 32. Flanges 64 help prevent carriage assembly 14 from moving upwardly and also prevent rotation of carriage assembly 14 by virtue of their frictional engagement with wing flanges 50.

Lead screw 16 is rotatably mounted in the end frame members 22, 24 by means of bearings 66, and also threadably extends through the threaded bore 42 of sleeve 40. Bearings 66 may be varied without detracting from the invention. A crank handle 68 is fixed to one end of lead screw 16 for causing rotation of the lead screw 16. The provision of nut 69 permits the rotation of lead screw 16 to be accomplished not only by handle 68 but also by a pneumatically powered wrench such as commonly used in tire repair facilities. Rotation of lead screw 16 causes carriage assembly 14 to move longitudinally with respect to lead screw 16 and also with respect to frame assembly 12. Carriage assembly 14 does not rotate in response to rotation of lead screw 16 by virtue of the fact that wing flanges 50 are nested below flanges 64 of angles 30, 32. The longitudinal movement of carriage assembly is also facilitated by virtue of the bearing engagement between wheel bearings 46, 48 and the downwardly presented surfaces 62 of track frames 26, 28. This bearing engagement is particularly important when a load is being carried by the device because the weight of the load is borne primarily by the bearing engagement between bearings 46, 48 and track frames 26, 28.

Referring to FIGS. 5 and 6, the method of operation of the device is shown. A load 70 is suspended from the opposite ends of frame assembly 12 by means of chains 36. Chain 58 connects a load lifting device (not shown) to link 52.

If the load 70 has an irregular shape, there is usually difficulty in ascertaining the center of gravity so that the load will be suspended in balance. This difficulty is overcome by the present invention merely by rotating crank handle 68 so as to move the link 52 longitudinally with respect to frame assembly 12 until the load 70 is in balance. The lead screw provides infinite adjustment, and the carriage assembly 14 moves easily by virtue of the bearing wheels 46, 48 engaging the track frames 26, 28. These bearing wheels also minimize the need for the load to be carried by the lead screw 16, thereby also reducing the binding between the lead screw 16 and the sleeve 40 of carriage assembly 14.

If it is desired to change the angle of attitude of the load 70, all that is necessary is to rotate crank handle 68 to move the link 52 to the position shown in FIG. 6. The pivotal mounting at the opposite ends of link 52 permits link 52 to pivot, both with respect to carriage assembly 14 and with respect to the load lifting chain 58. It is important that link 52 be able to pivot both at its upper end and at its lower end in order to facilitate this action. The bearing wheels 46, 48 also facilitate this action since they will bear the load bearing forces regardless of the angle of attitude of frame assembly 12.

Figure 7:
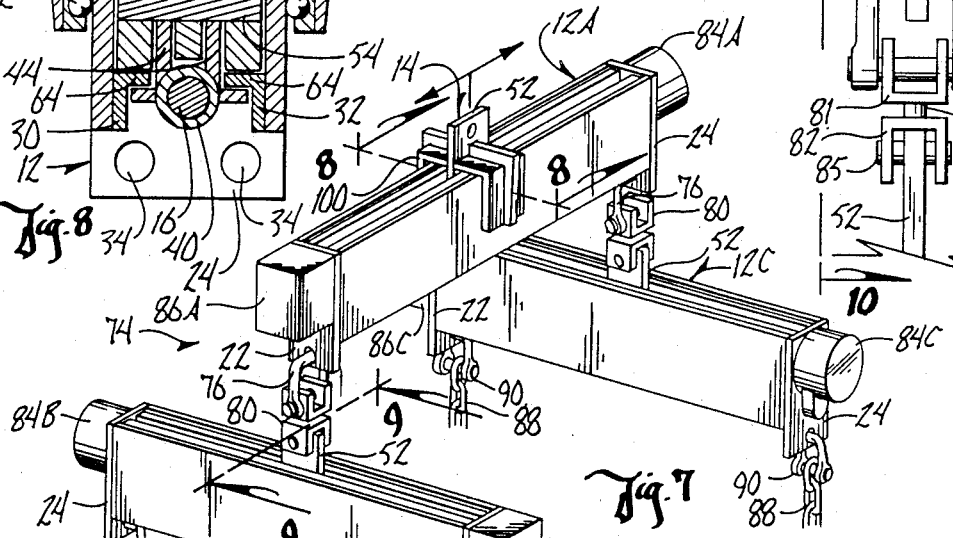
FIG. 7 is a perspective view of a modified form of the present invention.

Referring to FIGS. 8–11, a modified form of the present invention is shown. The interior structure of the various frame assemblies is the same as that shown in FIGS. 1–6, and the use of the same numerals indicates corresponding parts. The device of FIG. 7 is indicated generally by the numeral 74, and comprises three frame assemblies 12A, 12B, 12C, which are arranged in an H or I configuration. Frame assembly 12A has its opposite end frames 22, 24 pivotally connected to the upper ends of links 52 of frame assemblies 12B and 12C, respectively. This pivotal mounting is accomplished by a swivel joint shown in FIGS. 9 and 10. The joint comprises a shackle 76 having a pin 78 extending between its lower ends and supporting a swivel assembly 80. Swivel assembly 80 comprises upper and lower U-shaped members 81, 82 interconnected by a swivel axle or pin 83. Lower U-shaped members 82 include a pin 85 which provides a pivotal connection to link 52. Shackle 76 and swivel assembly 80 permit universal movement of end frame 22 of frame assembly 12A with respect to link 52 of frame assembly 12B.

Instead of using a crank assembly 68 such as shown in the device of FIGS. 1–6, the device 74 utilizes electric motors 84A, 84B and 84C to rotate the lead screw 16. In order to counterbalance the weight of motors 84A, 84B and 84C, each frame assembly is provided at its opposite end with a counterweight 86A, 86B, 86C, respectively, so as to permit the frame assembly to be substantially balanced when the link 50 is positioned centrally along its length.

The opposite ends of frame assemblies 12B and 12C are adapted to be connected to four load bearing chains 88 by means of shackles 90 which are connected to the opposite ends of assemblies 84B and 84C as shown in FIG. 7.

Figure 8:
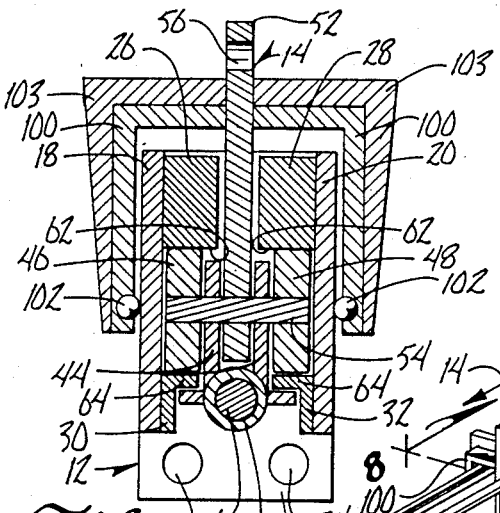
FIG. 8 is a sectional view taken along line 8—8 of FIG. 7.

Because the link 52 of assembly 12A must bear very large loads, it is necessary to provide reinforcing flanges 100 which are attached to link 52 and extend down along the sides 18, 20 of frame assembly 12A as shown in FIG. 8. A reinforcing rib 103 adds strength to flanges 100. Rotatably mounted on the interior of flanges 100 are a pair of ball bearings or wheels 102 which are mounted in suitable sockets in flanges 100 and which engage the sides 18, 20 of frame assembly 12A to permit the carriage assembly to move longitudinally. Flanges 100 prevent tracks 26, 28 from bowing outwardly away from one another in response to extremely heavy loads.

Figure 9:
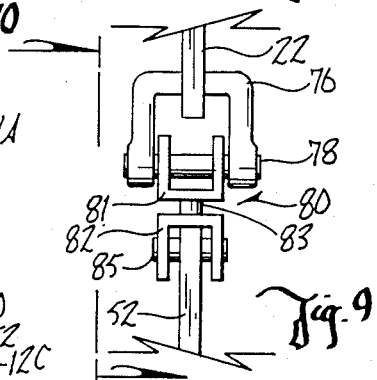
FIG. 9 is a view taken along line 9—9 of FIG. 7.
Figure 11:
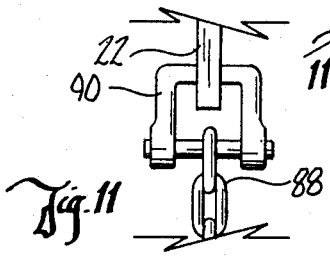
FIG. 11 is a view taken along line 11—11 of FIG. 7.
Figure 10:
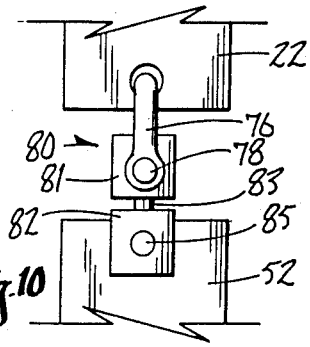
FIG. 10 is a view taken along line 10—10 of FIG. 9.

The device 74 shown in FIGS. 8–10 can be utilized for leveling a load being suspended by four chains 88. The lifting device is mounted to the link 52 of frame assembly 12A. If the load is out of balance, the adjustments can be made to each of the three links 52 of frame assemblies 12A, 12B and 12C until the desired balance is obtained for the load so that no particular chain 88 will bear any greater load than the other cables. This application has considerable advantage for use in lifting loads with a crane or other device where large, irregular loads are lifted.

The device provides infinite adjustment, and it provides strong and secure means for bearing the load. The use of the roller bearings and the lead screw minimize the binding which occurs during adjustment so that free and easy adjustment can be obtained regardless of the weight of the load. The device can be utilized with remote controls when electric motors 84A, 84B and 84C are used. While electric motors are shown, other power means could be used such as hydraulic motors, servo motors or other devices. The attachment of the load bearing cables to the load should be made above the center of gravity of the load for safety. Usually the carriage assembly is centered before attaching the load to the device. It can then be adjusted to the desired position after the load has been suspended.

Thus, it can be seen that the device of the present invention accomplishes at least all of its stated objectives.

What is claimed is:

1. A load leveling device for connecting a load to a lifting device, comprising:

an elongated frame assembly having first and second side frame members, first and second opposite end frame members, first and second spaced apart track members attached to said first and second side frame members respectively and having upper and lower surfaces, and first and second spaced apart flanges attached to said first and second side frame members respectively and spaced apart from said first and second track members respectively;

said side frame members, said track members, and said flanges forming an elongated channel;

first and second spaced apart attachment means on said elongated frame assembly for permitting attachment of said load to said elongated frame assembly;

a carriage assembly having bearing means within said channel and engaging said lower surface of said track members for permitting longitudinal movement of said carriage assembly along said track members and having first and second wing flanges extending towards said side frame members and positioned beneath said first and second flanges of said frame assembly respectively for limiting upward and rotational movement of said carriage assembly;

lead screw means rotatably mounted to said frame assembly and threadably engaging said carriage assembly for causing longitudinal movement of said carriage assembly on said track members;

power means connected to said lead screw means for causing rotating of said lead screw means to cause longitudinal movement of said carriage assembly on said track members:

third attachment means pivotally connected to said carriage assembly for permitting attachment of said lifting device to said carriage assembly.

2. A device according to claim 1 wherein said bearing means comprise at least one roller rotatably mounted to said carriage assembly and mounted for rolling engagement against said lower surfaces of said track members.

3. A device according to claim 1 wherein said track members engage said bearing means and limit upward movement of said carriage assembly with respect to said frame assembly, said flanges of said frame assembly engaging said wing flanges of said carriage assembly and limiting upward movement of said carriage assembly with respect to said frame assembly and limiting rotational movement of said carriage assembly with respect to said lead screw means during longitudinal movement of said carriage assembly along said track members.

4. A device according to claim 1 wherein said third attachment means comprises an elongated link having a lower end pivotally mounted to said carriage assembly and an upper end adapted to be pivotally mounted to said lifting device.

5. A device according to claim 4 wherein said lower end of said link is below said track members and said upper end of said link is above said track members, said link being positioned between said track members.

6. A device according to claim 1 wherein said power means comprises a crank handle.

7. A device according to claim 1 wherein said power means comprises an electric motor.

8. A load leveling device for connecting a load to a lifting device comprising:

first, second and third elongated frame assemblies, each having first and second opposite ends, and each having an elongated track frame;

each of said frame assemblies having a carriage assembly movably mounted thereto, said carriage assembly having bearing means engaging said track frame for permitting longitudinal movement of said carriage assembly along the length of said track frame;

each of said frame assemblies having lead screw means rotatably mounted thereto and threadably engaging said carriage assembly thereon for causing longitudinal movement of said carriage assembly with respect to said track frame;

each of said lead screw means having power means connected thereto for rotating said lead screw means to cause longitudinal movement of said carriage assembly on said track frame;

first link means pivotally connecting said carriage assembly of said first frame assembly to said first end of said second frame assembly;

second link means for pivotally connecting said carriage assembly of said second frame assembly to said lifting device;

third link means pivotally interconnecting said carriage assembly of said third frame assembly to said second end of said second frame assembly and attachment means at each end of said first and third frame assemblies for permitting attachment of said load to said leveling device at four spaced apart locations.

9. A device according to claim 8 wherein said first and second ends of said first and third frame assemblies include chain attachment means for connection to a load bearing chain.

* * * * *